US006886331B2

(12) United States Patent
Joshi

(10) Patent No.: US 6,886,331 B2
(45) Date of Patent: May 3, 2005

(54) MAGNETOHYDRAULIC MOTOR

(75) Inventor: Chandrashekhar H. Joshi, Bedford, MA (US)

(73) Assignee: Energen, Inc., Lowell, MA (US)

( * ) Notice: Subject to any disclaimer, the term of this patent is extended or adjusted under 35 U.S.C. 154(b) by 19 days.

(21) Appl. No.: 10/316,285

(22) Filed: Dec. 11, 2002

(65) Prior Publication Data

US 2003/0108439 A1 Jun. 12, 2003

Related U.S. Application Data

(60) Provisional application No. 60/341,059, filed on Dec. 12, 2001.

(51) Int. Cl.[7] ..... F04B 35/04
(52) U.S. Cl. ..... 60/473; 417/322
(58) Field of Search ..... 60/473, 476; 92/92; 417/322, 413.2

(56) References Cited

U.S. PATENT DOCUMENTS 4,726,741 A * 2/1988 Cusack ..... 417/322
5,857,662 A * 1/1999 Kappel et al. ..... 60/545

* cited by examiner

*Primary Examiner*—Edward K. Look
*Assistant Examiner*—Michael Leslie
(74) *Attorney, Agent, or Firm*—Choate, Hall & Stewart

(57) ABSTRACT

A magnetohydraulic motor with a positive displacement pump that pumps hydraulic fluid to and from the two sides of a bi-directional piston that provides the motor's output force and motion. Motion control is provided by properly controlling valves that selectively open and close fluid passageways between the actuator member and each side of the piston.

7 Claims, 3 Drawing Sheets

MAGNETOHYDRAULIC MOTOR

CROSS REFERENCE TO RELATED APPLICATION

This application claims priority of Provisional application Ser. No. 60/341,059, filed on Dec. 12, 2001.

FIELD OF THE INVENTION

This invention relates to a magnetically-actuated hydraulic motor that provides both high force and precise position control.

BACKGROUND OF THE INVENTION

Hydraulic motor systems typically require a large motor to pump hydraulic fluid to a piston. Accordingly, when hydraulic motor systems are used to move small or remote structures, hydraulic lines must be employed to move the hydraulic fluid from the motor to the actuated-member. These lines add weight, expense, and additional potential failure points, thus increasing the complexity, cost and size of these systems.

SUMMARY OF THE INVENTION

Magnetic shape memory materials (SMM) are metal alloys that undergo a phase transition when exposed to moderate magnetic fields. The phase change is reversible and repeatable. Strains of several percent are available.

SMMs are alloys of Nickel-Manganese-Gallium. Some SMM alloys show potential for high strain at temperatures approaching room temperature. SMMs exhibit strains that exceed the capabilities of rare-earth-based magnetostrictor materials.

Unlike magnetostrictive materials in which the magnetic moment is anisotropic, a shape memory material undergoes a transformation from martensitic to a body-centered cubic structure with an accompanying volume change that can be as high as 5%. This order-of-magnitude higher change translates into more compact actuators that have wide applications for vibration control, electromechanical devices, robotics, etc.

Bulk samples of this alloy have been fabricated by weighing out the appropriate combination of the nickel, manganese and gallium and arc melting under an argon atmosphere. The alloy was re-melted several times to ensure a good alloy blend and then chill cast into a copper mold.

The magnetostriction of this material composition was measured under an applied magnetic field of 3 kOe and an elongation of 0.7% was observed. By changing the relative amount of manganese, nickel and gallium, the phase transition can be shifted in temperature and broadened to fit the needs of various applications.

This invention features a magnetohydraulic motor that provides high force actuation. The motor can be used in any relevant application, one of which is for aircraft flight control surfaces. The basic concept of the inventive motor is as follows. The motor consists of a pump operated by a shape-changing material, a pair of flow control valves and a piston that amplifies the force and displacement. Magnetic shape memory materials are preferably used to pressurize and move the hydraulic fluid into and out of the piston.

The positive displacement SMM pump is the heart of the inventive motor. It consists of a rod of shape memory material enclosed in a sealed shell, with two valves at one end. The SMM is not constrained, except at one end where it is bonded to the shell. An external coil is used to impose a magnetic field on the SMM. Activation of the SMM pump via an electrical current induces the SMM to extend or contract. The pump can provide pressure and flow on demand.

In operation, the pump would be excited by an oscillating current, which in turn causes the pump to push the hydraulic fluid in an oscillating manner at twice the frequency of the AC current. This occurs because the SMM changes its length in proportion to the amplitude of the magnetic field.

There are two flow control valves. These valves are driven open and closed at a frequency equal to the pumping frequency. The timing of the valves corresponds to the pressure cycle in the pump so that the maximum flow and pressure can be delivered to the piston.

The piston serves to amplify the stroke and force capability of the SMM pump. By continuously pumping in one direction, the piston can be moved a relatively great distance depending on the motor design, and the pump flow rate and frequency.

One of the advantages of this valving scheme is that to reverse direction of actuation, only the timing of the valves needs to be changed. Thus, the response time to any change can be very rapid. This timing sequence can be controlled by a standard digital controller.

In an alternate embodiment, the shape memory material of the pump is used to move a bellows back and forth rather than to directly pump the hydraulic fluid. This configuration magnifies the SMM movement, and thus is desirable when the volume change of the shape memory material is negligible, or insufficient for the desired pumping flow rate.

Another alternative embodiment can be accomplished by replacing the magnetic shape memory material with a magnetostrictive material. Although the dimensional change of the magnetostrictor is less than the shape memory material, the pump will still function in the same manner, but with reduced motion capability.

Other embodiments can be accomplished by replacing the magnetic shape memory material and its coil with a piezoelectric or electrostrictive actuator. These materials change shape upon application of an electric field as opposed to a magnetic field. Because the strains are extremely small, significant elongation requires that the actuator member comprise a number of piezoelectric or electrostrictive portions arranged in series, and each connected across a voltage source.

The advantages of the invention are:

high strain material is used to provide high pumping capacity;

compact motor size;

high speed response to changes in direction;

by operating the SMM pump at a constant frequency equal to its mechanical resonance, the efficiency can be maximized;

a small digital controller and electrical controls eliminate hydraulic lines and their associated weight and inefficiency.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

This invention may be accomplished in a magnetohydraulic motor that can be an extremely small size yet accomplish high force, rapid response time, and minutely-controllable position. These aims are accomplished by using a shape-changing material in the pump actuator member. These materials include shape memory materials (SMM), magnetostrictive materials, piezoelectric materials, and electrostrictive materials. Each of these materials changes shape upon the application of an electrically-derived magnetic or electrical field, as appropriate for the material. These materials have high force output and small but controllable and repeatable motions that can translate into pumps with an output that accomplishes these advantages.

Figure 1:
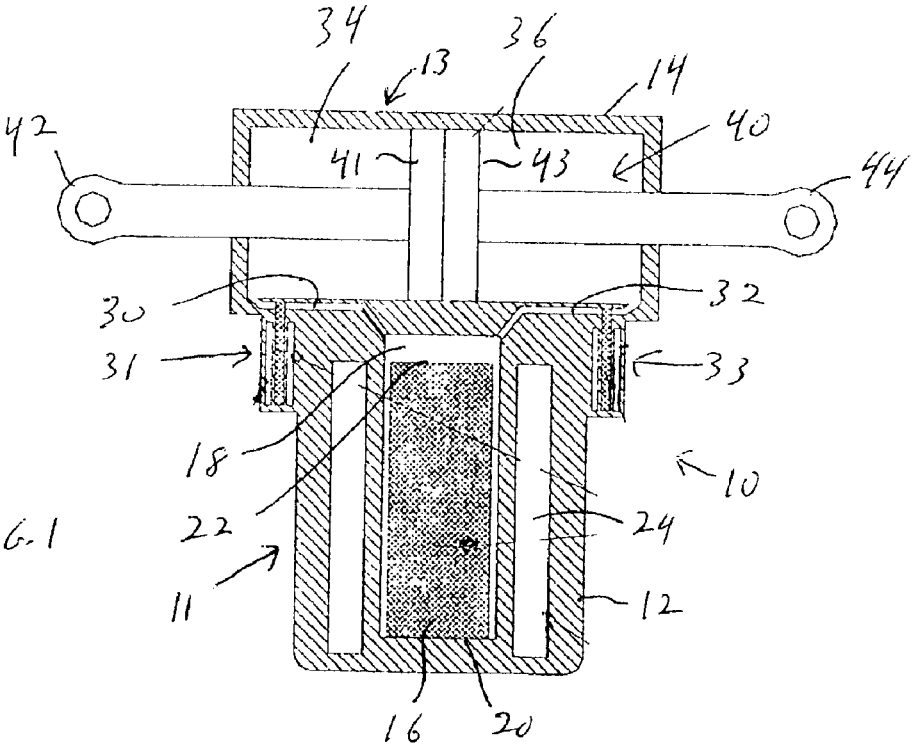
FIG. 1 is a schematic, cross-sectional view of the preferred embodiment of the magnetohydraulic motor of this invention.

There is shown in FIG. 1 magnetohydraulic motor 10 according to this invention. Motor 10 comprises positive displacement pump 11 and hydraulic piston portion 13. Pump 11 comprises actuator-housing 12 that holds shape-changing actuator member 16 surrounded by coil 24 that selectively applies a magnetic field to actuator member 16. Member 16 is anchored at end 20 to housing 12 with the other end 22 free to move upon the application of the magnetic field. Hydraulic fluid chamber 18 is in fluid communication with actuator member 16 so that motion of member 16 causes pumping of fluid in chamber 18 through one or both of fluid communication channels 30 and 32. Channels 30 and 32 lead to fluid chambers 34 and 36, respectively, that are on either side of piston 40 having fluid-actuatable surfaces 41 and 43 and piston output numbers 42 and 44. Passageways 30 and 32 can be selectively opened and closed with electrically-operable valves 31 and 33, respectively.

Valves 31 and 33 may each comprise a shape-changing valve actuator member fixed at one end, with the other end coupled to a movable closure member that is adapted to close and open the fluid communication passageway. The valves could be accomplished in other manners such as with more traditional solenoid-actuated closure members that can also be more traditional valve-member constructions. Non-limiting examples include ball valves, gate valves, and butterfly valves.

Figure 2:
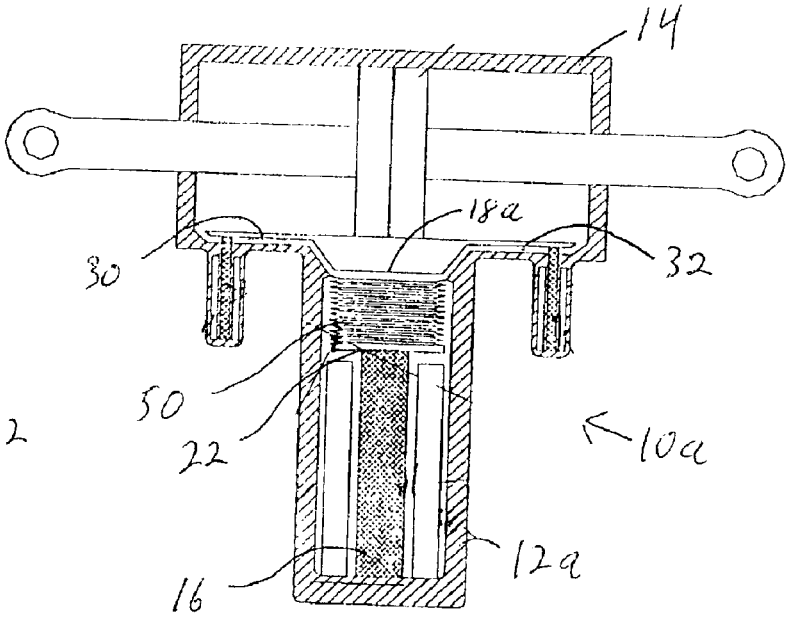
FIG. 2 is a similar view of an alternative embodiment that employs a bellows to magnify the actuator motion.

An alternative preferred embodiment is shown in FIG. 2. The difference is that in this case actuator-member 16 is coupled at its free end 22 to bellows members 50 that moves fluid in chamber 18*a*. The bellows can magnify the relatively small displacement of the actuator member to accomplish greater fluid displacement for a desired purpose.

Figure 3:
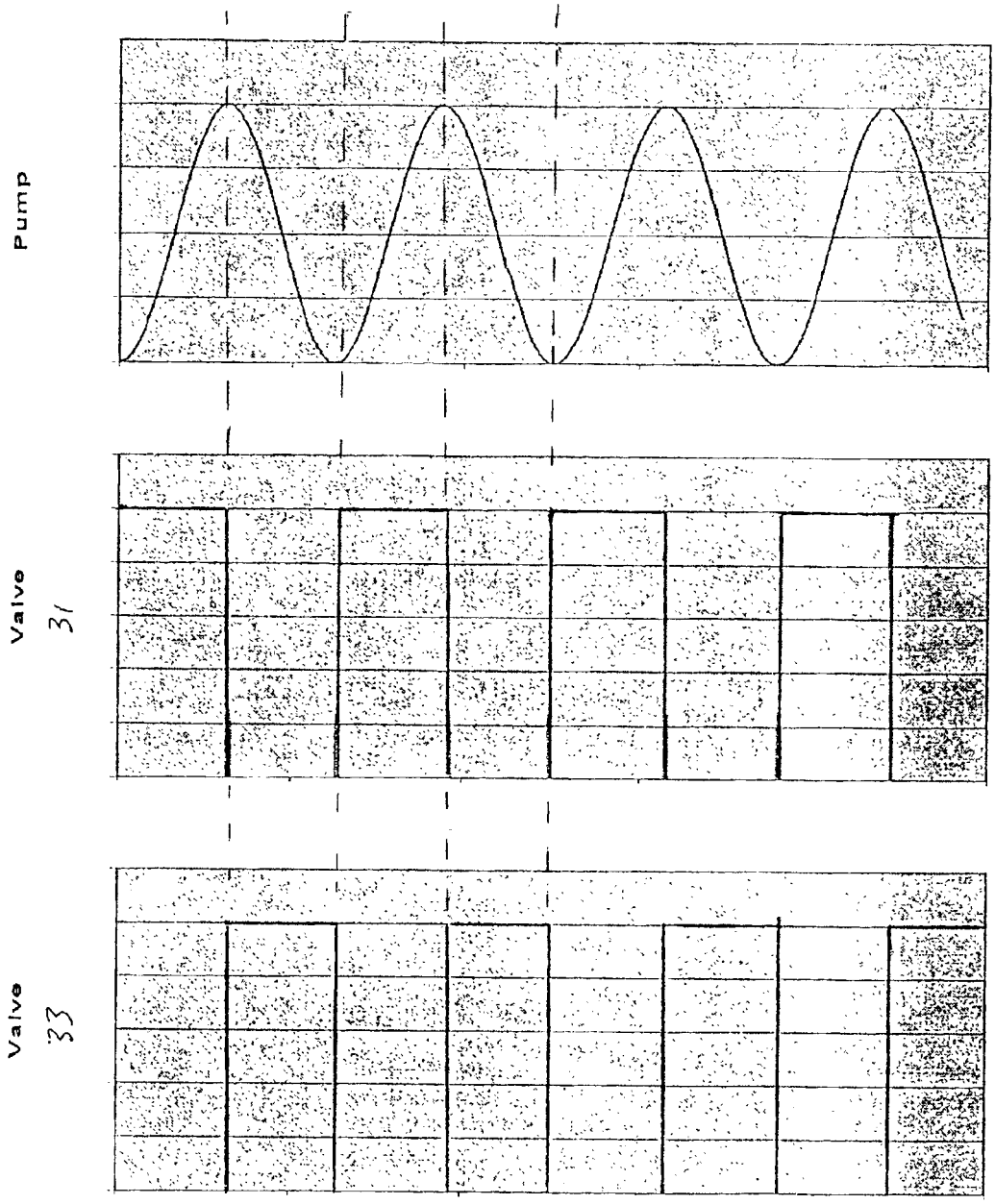
FIG. 3 is a series of graphs showing one embodiment of the pump motion and valve control for the magnetohydraulic motors of FIGS. 1 and 2.

FIG. 3 shows one pump actuation and valve control scheme useful for any embodiment of the invention. In this case, the pump actuator member is excited by an oscillating current. The valves are opened and closed at a frequency equal to the pumping frequency. The timing of the valves corresponds to the pressure cycle in the pump. This achieves maximum hydraulic fluid flow and pressure, which translates to maximum force and speed of the piston. Other control schemes are possible depending on the desired use of the motor. For example, in instances in which force needs to be applied in only one direction, the piston can have only one force-actuating surface. There could be a single fluid communication channel and a single valve that was opened only during the pressure cycle of the pump. This can cause small or large motions of the piston. The pressure could be relieved by opening the valve when the actuator member is relaxed.

Figure 4:
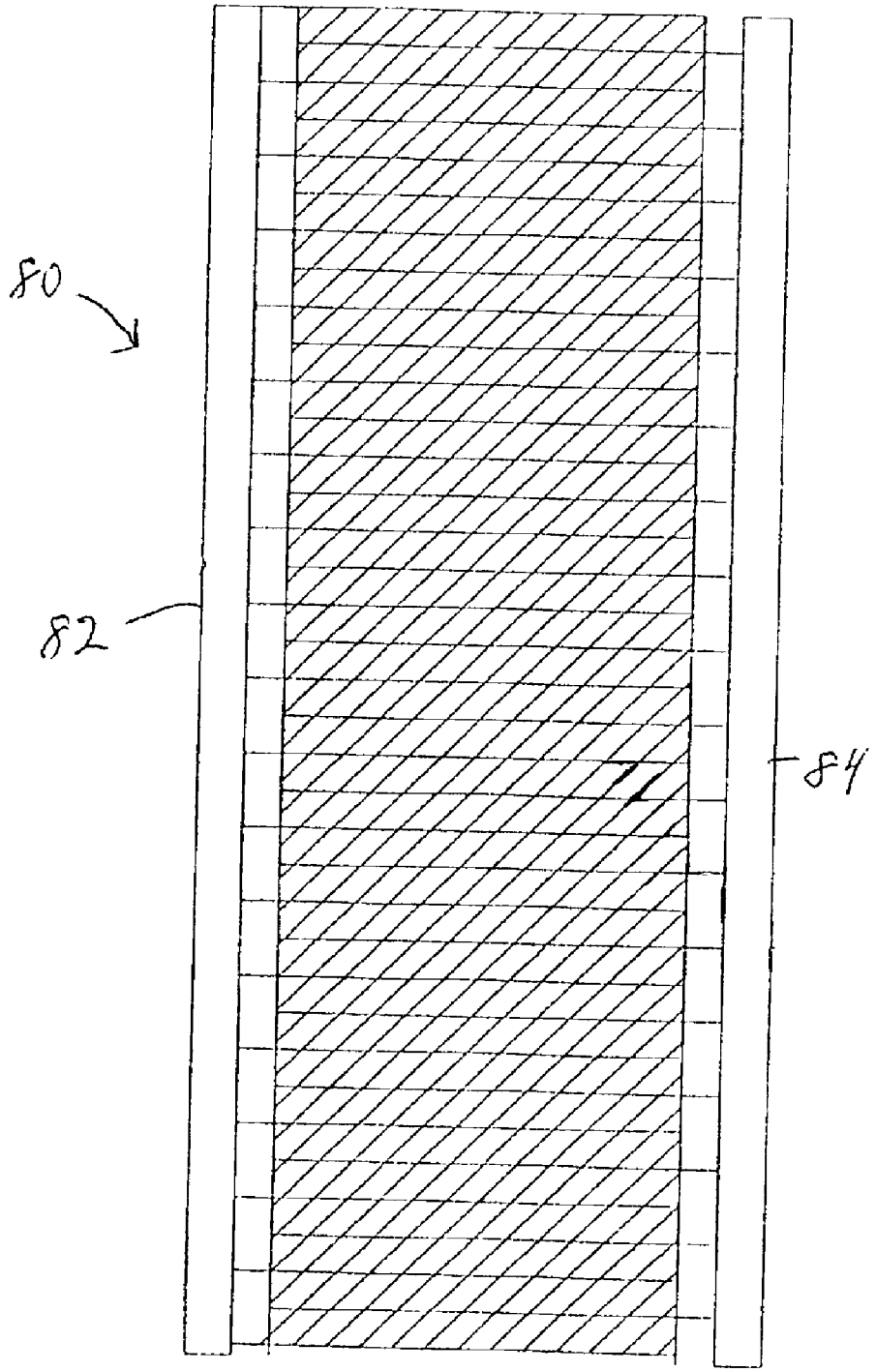
FIG. 4 is an enlarged, schematic, cross-sectional view of a piezoelectric or electrostrictive-based shape-changing actuator member for the invention.

FIG. 4 schematically depicts a piezoelectric or electrostrictive shape-changing actuator member 80 that comprises a large number of sections of piezoelectric or electrostrictive material arranged so that their motions are additive. These sections are placed across positive and negative electrodes 82 and 84 so that the proper voltage differential can be placed across the elements as necessary to accomplish a shape change, as would be known by those skilled in the art.

Although specific features of the invention are shown in some drawings and not others, this is for convenience only as some feature may be combined with any or all of the other features in accordance with the invention.

Other embodiments will occur to those skilled in the art and are within the following claims.

What is claimed is:

1. A magnetohydraulic motor, comprising:

a positive displacement pump comprising:

a shape-changing actuator member comprising a magnetic shape memory material;

means for controllably applying an electrically-derived field to the actuator member to cause the member to reversibly change shape; and a hydraulic fluid chamber in communication with the actuator member;

a hydraulic piston having two sides, the piston movable in two directions by the force of hydraulic fluid;

fluid communications passageways connecting the pump's fluid chamber to each side of the piston; and electrically-operable valves for selectively opening and closing each fluid communications passageway, to selectively move hydraulic fluid between the fluid chamber and the two sides of the piston, and thereby cause motion of the piston.

2. The magnetohydraulic motor of claim 1 wherein the means for controllably applying an electrically-derived field comprises a coil surrounding the actuator member for selectively applying a magnetic field to the actuator member.

3. The magnetohydraulic motor of claim 1 wherein the pump further comprises an actuator housing.

4. The magnetohydraulic motor of claim 1 wherein the valves each comprise a shape-changing valve actuator member fixed at one end, with the other end coupled to a movable closure member adapted to close and open a fluid communication passageway, and means for controllably applying an electrically-derived field to the valve actuator member, to cause the member to reversibly change shape and thereby move the movable closure member.

5. The magnetohydraulic motor of claim 1 further comprising a piston housing containing the piston, and defining a piston-actuating fluid chamber on each side of the piston.

6. A magnetohydraulic motor, comprising:

an actuator housing:

a magnetic shape memory material (SMM) actuator coupled to the actuator housing at one end;

a hydraulic fluid within the actuator housing, and in fluid communication with at least the free end of the SMM actuator;

a selectively-actuatable coil for selectively applying a magnetic field to the actuator, to cause the actuator to change shape and thus move the fluid within the actuator housing;

a piston for translating fluid movement to external mechanical motion;

a piston housing surrounding the piston and defining one or more piston-actuating fluid chambers;

one or more fluid communication channels for directing fluid between the actuator housing and the piston-actuating fluid chambers; and a selectively-operable valve in the fluid communication channel, for selectively transferring fluid between the actuator housing and the piston-actuating fluid chamber, to selectively move the piston and thereby cause external mechanical motion.

7. The magnetohydraulic motor of claim 6 wherein the piston has two sides and is movable in two directions, and there is a piston-actuating fluid chamber on each side of the piston, and separate fluid communication channels for directing fluid between the actuator housing and each piston-actuating fluid chamber.

* * * * *